US005905220A

United States Patent [19]

Lee et al.

[11] Patent Number: 5,905,220

[45] **Date of Patent: *May 18, 1999**

[54] METHOD AND APPARATUS FOR SENSING PEDAL MOTION AND ACTUATING PEDALS IN PLAYER PIANOS

[75] Inventors: Charles R. Lee, Placerville; Pamela K. Clift, Vacaville; Alana J. Yorba, Carmichael, all of Calif.

[73] Assignee: Burgett, Inc., Sacramento, Calif.

[ * ] Notice: This patent is subject to a terminal disclaimer.

[21] Appl. No.: 08/829,927

[22] Filed: Mar. 27, 1997

[51] Int. Cl.[6] ..... G10G 3/00

[52] U.S. Cl. ..... 84/461; 84/33; 84/225

[58] Field of Search ..... 84/461, 462, 463, 84/225, 33, 34

[56] References Cited

U.S. PATENT DOCUMENTS

| | | | |
|---|---|---|---|
| 4,216,694 | 8/1980 | Ramsey et al. | 84/23 |
| 4,450,749 | 5/1984 | Stahnke | 84/462 |
| 5,016,513 | 5/1991 | Stahnke | 84/19 |
| 5,131,306 | 7/1992 | Yamamoto | 84/19 |
| 5,231,283 | 7/1993 | Starkey et al. | 250/229 |
| 5,524,521 | 6/1996 | Clift et al. | 84/462 |

*Primary Examiner*—Jonathan Wysocki
*Assistant Examiner*—Shih-yung Hsieh
*Attorney, Agent, or Firm*—John P. O'Banion

[57] ABSTRACT

A piano pedal optical sensor apparatus and method for accurately measuring, recording and reproducing the pedal expression generated during piano performances. A plurality of optical emitter/sensors are mounted on the pedal support assembly of a piano, and a plurality of corresponding optical reflectors are mounted on the moving connecting rods associated with piano pedals on the piano. Output voltage signals from the optical emitter sensors, which vary according to pedal movement, are monitored and used to generate and record pedal position values. The recorded pedal position values are then used to recreate the original pedal expression of the piano performance by generation of pulse width modulation signals which are used to drive solenoids associated with piano pedals.

19 Claims, 5 Drawing Sheets

METHOD AND APPARATUS FOR SENSING PEDAL MOTION AND ACTUATING PEDALS IN PLAYER PIANOS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to devices and methods for detecting, recording and reproducing the effects or expression of piano pedals which occur during piano performances, and more particularly to a piano pedal optical sensor apparatus and method which accurately detects and records piano pedal expression, which accurately reproduces the piano pedal expression, and which is quickly and easily retrofitable to existing acoustic pianos.

2. Description of the Background Art

Reproduction of piano music has long been carried out by "player pianos" which reproduce the notes of musical pieces on the player piano by mechanically, optically or electronically reading a recording of stored musical information from an information storage medium such as punched tape or magnetic or optical disk, and then actuating keys to strike strings according to the stored musical information. Accurate recording of the musical expression from a piano performance is necessary to avoid unexpressive, mechanical-sounding reproduction of the piano music. In order to faithfully reproduce a piano performance, every nuance and subtlety of the original performance must be captured and recorded.

One aspect of piano performances which is difficult to capture and record is the pedal movement or pedalling expression of a pianist which is generated by foot pedal activation of string damping and key shifting mechanisms within the piano. During a piano performance, the pianist will move and hold the foot activated pedals over a large range of positions which extend between the fully depressed and fully released pedal positions. Previously developed devices and methods for recording piano pedal movement have all proved deficient in that they are not able to precisely measure and recreate the pedal expression of the original performance. Particularly, currently known pedal expression recording devices tend to detect a two-state actuation wherein pedal expression is recorded as an "on" or "off" signal which is then reproduced as a fully depressed or fully released pedalling effect. This arrangement results in an undesirable mechanical sound in the reproduced piano music since the numerous intermediate pedal positions generated during the actual piano performance are not recorded and reproduced. Attempts have also been made to produce devices that record intermediate or "half" pedal positions, but these devices have proven ineffective.

Another problem associated with previously used pedal sensing devices and methods is that they are difficult to install and use on different pianos. During the many years in which acoustic pianos have been manufactured or produced by many sources, a very large number of different pedal mechanisms and designs have been employed. However, currently available pedal movement sensing devices generally are specialized for specific types of pedal mechanisms, and thus different acoustic pianos from different sources cannot easily be modified or retrofitted to accommodate the pedal sensing devices.

Therefore, there is a need for a piano pedal optical sensor apparatus and method which accurately records every nuance and aspect of piano pedal movement and expression, which eliminates mechanical sounding piano music reproduction, and which can be easily installed on all varieties and makes of conventional acoustic pianos. The present invention satisfies those needs, as well as others, and generally overcomes the deficiencies found in the background art.

BRIEF SUMMARY OF THE INVENTION

The present invention pertains to a piano pedal optical sensor apparatus and method which accurately senses and records pedal expression during piano performances and which is easily installed on all types of acoustic pianos. In general terms, the apparatus of the invention comprises a plurality of optical emitters/sensors and a plurality of optical reflectors which are associated with a plurality of piano pedals on an acoustic piano, and means for generating pedal position information according to output voltage signals from the emitter/sensors. Means for recording the pedal expression information is generally included with the invention, together with means for reproducing the recorded pedal expression.

By way of example, and not of limitation, the optical emitters/sensors each include a light emitting diode (LED) and a phototransistor sensor. The optical emitters/sensors preferably are fixedly mounted in a sensor bank. The optical reflectors comprise reflective surfaces which are mounted on portions of the pedal assembly which move in accordance with the piano pedals. Preferably, the optical reflectors are attached to connector rods associated with the pedal mechanical assembly on an acoustic piano. Generally there are three pedals provided with a standard acoustic piano, and three emitters/sensors and three reflective surfaces are utilized with the invention to monitor the movement of each of the three pedals. Light emitted from the LED of each emitter/sensor strikes the corresponding optical reflector and is directed back towards the corresponding phototransistor sensor. The phototransistor sensor generates output voltage signals responsive to the intensity of sensed light, which varies according to the distance between the reflector and emitter/sensor which in turn varies according to pedal movement.

The pedal expression generating means generally comprises an analog to digital converter which digitizes the output voltage signals, and a system controlling computer or microprocessor which processes the digitized output voltage signals and converts them to corresponding MIDI values. These pedal position values are then communicated to the recording means and recorded. The recording means preferably comprises a conventional disk drive and magnetic disks.

The means for generating pedal expression from the stored pedal position values preferably comprises a plurality of solenoids or other actuating means which are interfaced with the microprocessor through a solenoid driver, and which are positioned to actuate the pedals of the acoustic piano. The recorded pedal position information is read back into the microprocessor and correlated with the pedal position data in the look-up tables stored in the ROM. The pedal position data is converted to analog signals by a digital to analog converter. The analog signals are communicated to the solenoid driver which actuates the solenoids.

An object of the invention is to provide a piano pedal optical sensor apparatus and method which accurately senses and records the full range of pedal expression during piano performances.

Another object of the invention is to provide a piano pedal optical sensor apparatus and method which can be quickly and easily installed on any type of acoustic piano.

Another object of the invention is to provide a piano pedal optical sensor apparatus and method which is simple to use.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 3:
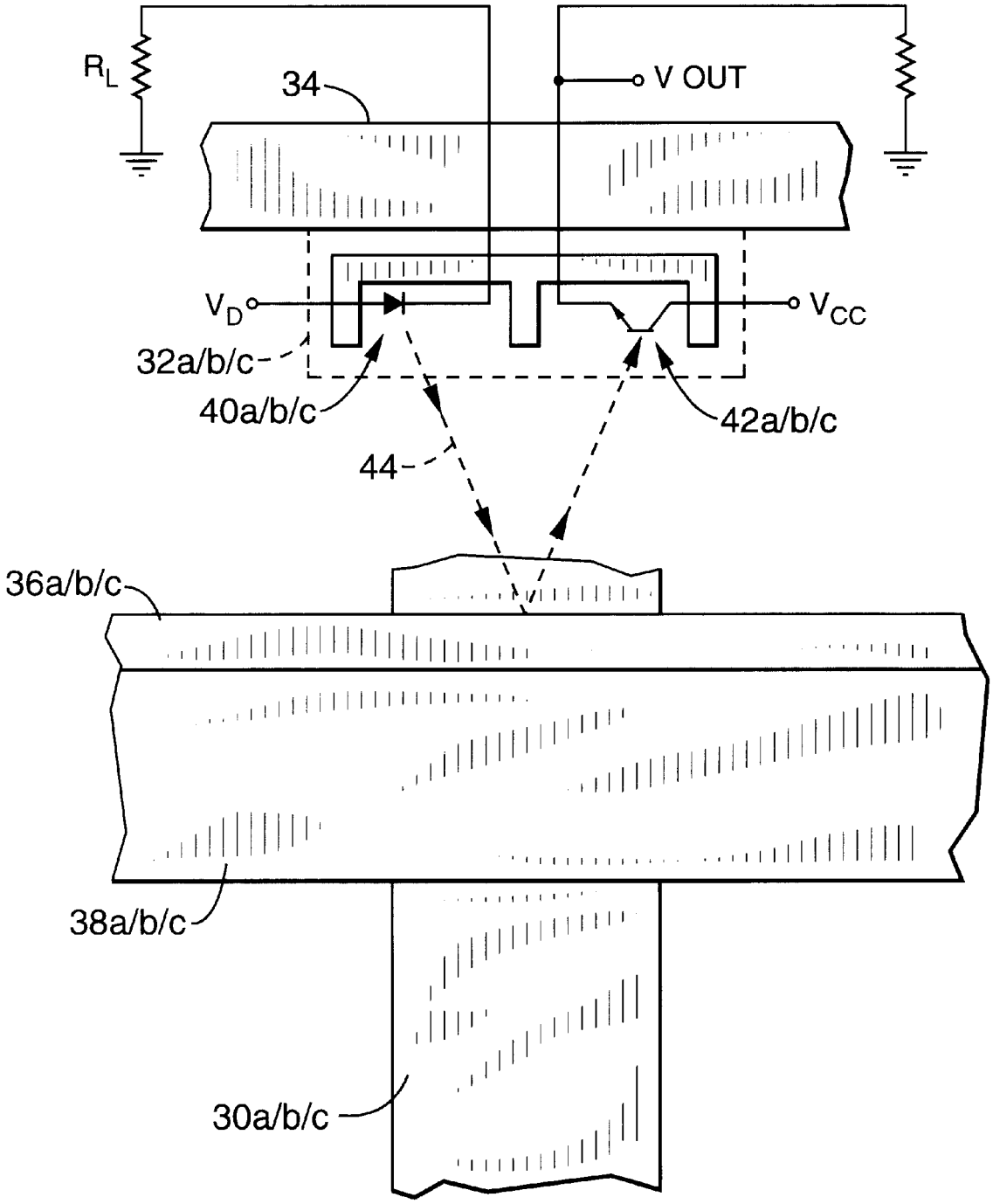
FIG. 3 is a schematic view in detail of an optical emitter/sensor and reflector.
Figure 4:
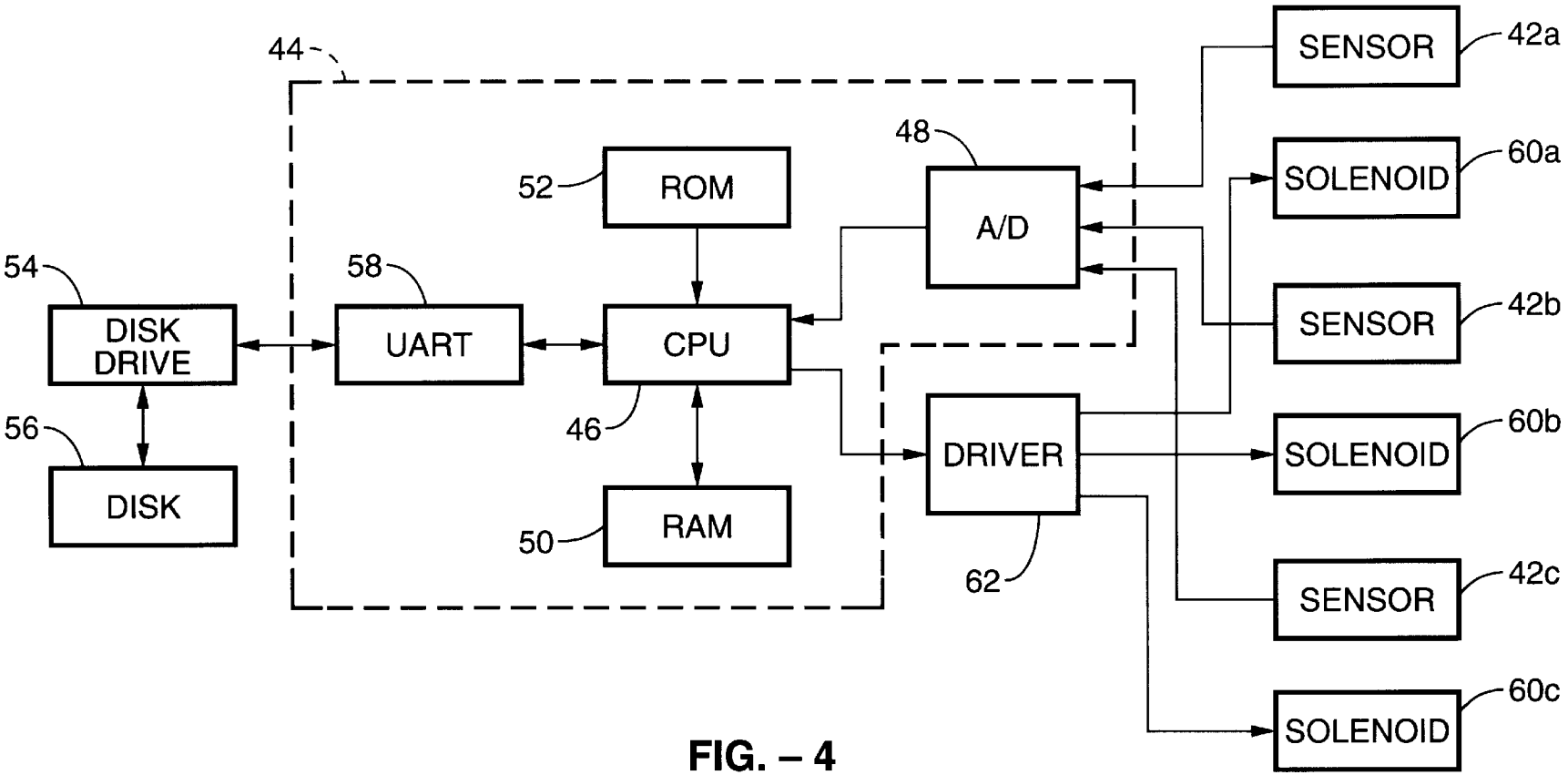
FIG. 4 is a functional block diagram of the piano pedal optical sensor apparatus of the invention.
Figure 5:
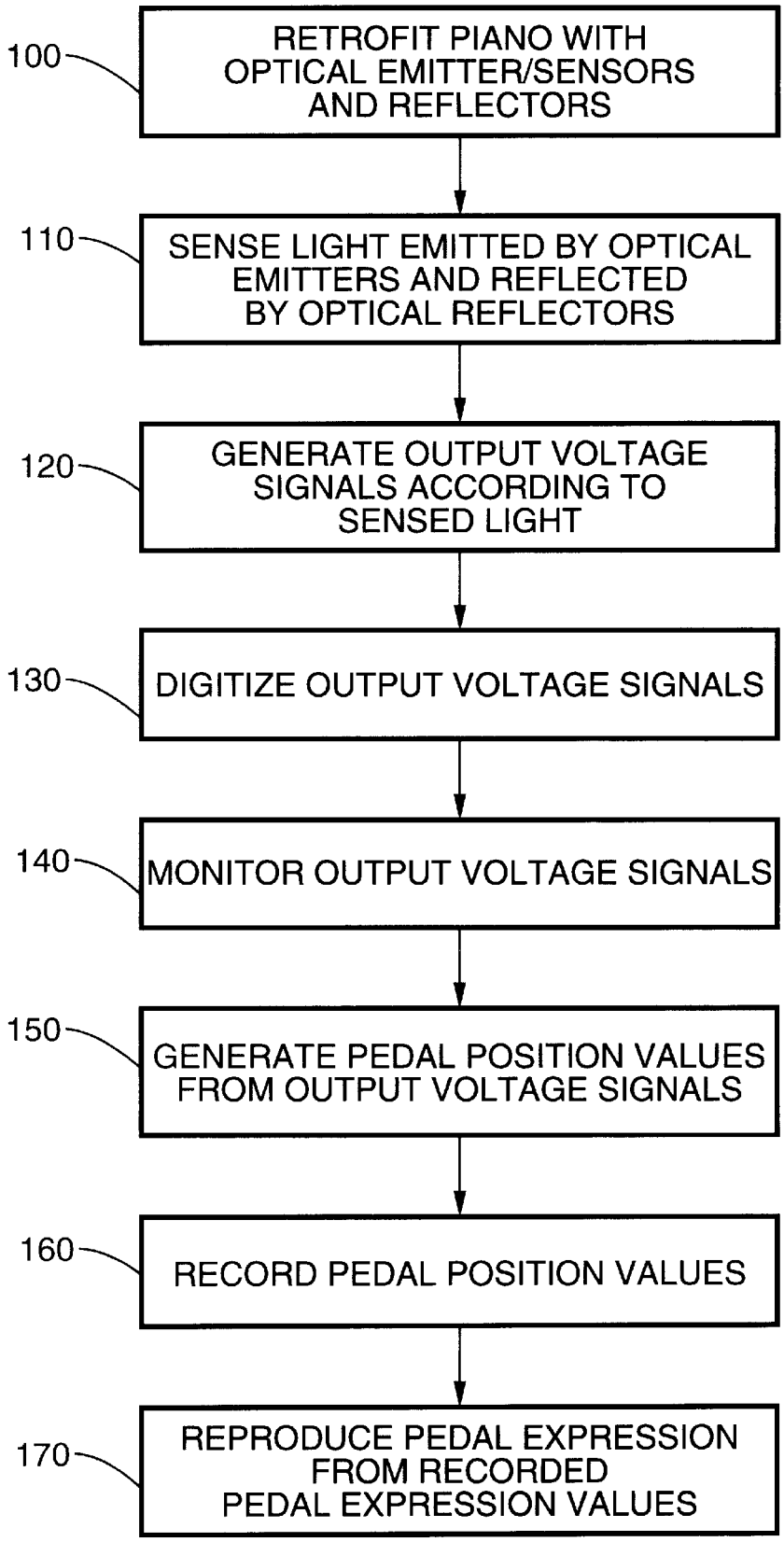
FIG. 5 is a flow chart showing generally the steps of the method of using the invention.

Referring more specifically to the drawings, for illustrative purposes the present invention is embodied in the apparatus generally shown in FIG. 1 through FIG. 4, where like reference numerals denote like parts, and the method outlined generally in FIG. 5. It will be appreciated that the apparatus may vary as to configuration and as to details of the parts, and that the method may vary as to details and to the order of the steps, without departing from the basic concepts as disclosed herein. The invention is disclosed generally in terms of use with a conventional acoustic piano. However, the invention may be utilized with other keyboard musical instruments which employ foot pedal controls.

Referring first to FIG. 1 through FIG. 4, a piano optical sensor apparatus 10 in accordance with the invention is generally shown. The apparatus 10 is used in conjunction with a conventional acoustic piano (not shown) having a pedal assembly 12 with a plurality of foot pedals 14*a*, 14*b*, 14*c*. Pedals 14*a*, 14*b*, 14*c* as shown correspond respectively to the damper pedal, sostenuto pedal, and una corda pedal which are provided with a conventional acoustic piano. Pedal assembly 12 includes a fixed or stationary support structure or lyre 16 which generally comprises a pair of vertical support members 18*a*, 18*b* and a pedal box 20 depending from vertical support members 18*a*, 18*b*. Vertical support members 18*a*, 18*b* are joined to and suspend downward from the body 22 of a piano. The fixed portion of pedal assembly 12, for the purposes of this disclosure, should be understood as including the portions of body 22 of the piano which are in proximity to pedal assembly 12. A horizontal brace 24 is generally included with lyre 16 and extends between vertical support members 18*a*, 18*b*. Pedals 14*a*, 14*b*, 14*c* are pivotally mounted in pedal box 20 such that depression of the toes 26*a*, 26*b*, 26*c* of pedals 14*a*, 14*b*, 14*c* results in elevation of the heels 28*a*, 28*b*, 28*c* respectively of pedals 14*a*, 14*b*, 14*c*. The heels 28*a*, 28*b*, 28*c* of pedals 14*a*, 14*b*, 14*c* are mechanically interfaced with connecting rods 30*a*, 30*b*, 30*c* which in turn operate conventional damping and key shifting mechanisms (not shown) within the piano. Pedals 14*a*, 14*b*, 14*c* and connecting rods 30*a*, 30*b*, 30*c* comprise moving portions of pedal assembly 12, and are shown in a relaxed or fully released position. During a piano performance, a piano player actuates pedals 14*a*, 14*b*, 14*c* which in turn drive connecting rods 30*a*, 30*b*, 30*c* and the internal damping and key shifting mechanisms, to effect musical expression in musical pieces performed on the piano.

The invention includes a plurality of optical emitter/sensor devices 32*a*, 32*b*, 32*c* which are preferably mounted in a sensor bank 34, and a corresponding plurality of optical reflectors 36*a*, 36*b*, 36*c*. Optical emitter/sensors 32*a*, 32*b*, 32*c* and optical reflectors 36*a*, 36*b*, 36*c* are mounted on pedal assembly 12 in a manner such that the distance separating each optical emitter/sensor 32*a*, 32*b*, 32*c* and corresponding optical reflector 36*a*, 36*b*, 36*c* varies with the movement of corresponding pedals 14*a*, 14*b*, 14*c* respectively. Sensor bank 34 and optical emitter/sensor devices 32*a*, 32*b*, 32*c* are preferably mounted on brace 24 between vertical support members 18*a*, 18*b* as shown, or on another stationary portion of pedal assembly 12 or the piano body 22 generally. Optical reflectors 36*a*, 36*b*, 36*b* which comprise mirrors or reflective surfaces, are preferably mounted on moving portions of the pedal assembly 12 associated with pedals 14*a*, 14*b*, 14*c* respectively, such that movement of pedals 14*a*, 14*b*, 14*c* by a piano player will result in a corresponding movement of reflectors 36*a*, 36*b*, 36*c*. Preferably, optical reflectors 36*a*, 36*b*, 36*c* are mounted on connecting rods 30*a*, 30*b*, 30*c* respectively by mounting bases 38*a*, 38*b*, 38*c*. Optical emitter/sensor devices 32*a*, 32*b*, 32*c* are preferably positioned in a downward facing orientation, and optical reflectors 36*a*, 26*b*, 26*c* are positioned to reflect upward, with optical emitter/sensor devices 32*a*, 32*b*, 32*c* positioned over optical reflectors 36*a*, 36*b*, 36*c* as shown.

Optical emitter/sensor devices 32*a*, 32*b*, 32*c* may alternatively be fixedly mounted on pedal box 20 or elsewhere on pedal assembly 12, and may positioned in an upward facing orientation, with optical reflectors 36*a*, 36*b*, 36*b* are positioned to reflect downward. As a further alternative, optical reflectors 36*a*, 36*b*, 36*b* may be fixedly mounted on brace 24 or another stationary portion of pedal assembly 12, while optical emitters/sensors 32*a*, 32*b*, 32*c* are individually mounted on connecting rods 30*a*, 30*b*, 30*c* respectively or on other moving portions of pedal assembly 12. In any case, optical emitters/sensors 32*a*, 32*b*, 32*c* and optical reflectors 36*a*, 36*b*, 36*c* are mounted on pedal assembly 12 such that optical emitters/sensors 32*a*, 32*b*, 32*c* are separated from the corresponding optical reflectors 36*a*, 36*b*, 36*c* respectively by a distance which varies with the corresponding movement of pedals 14*a*, 14*b*, 14*c* respectively, as related above.

Figure 1:
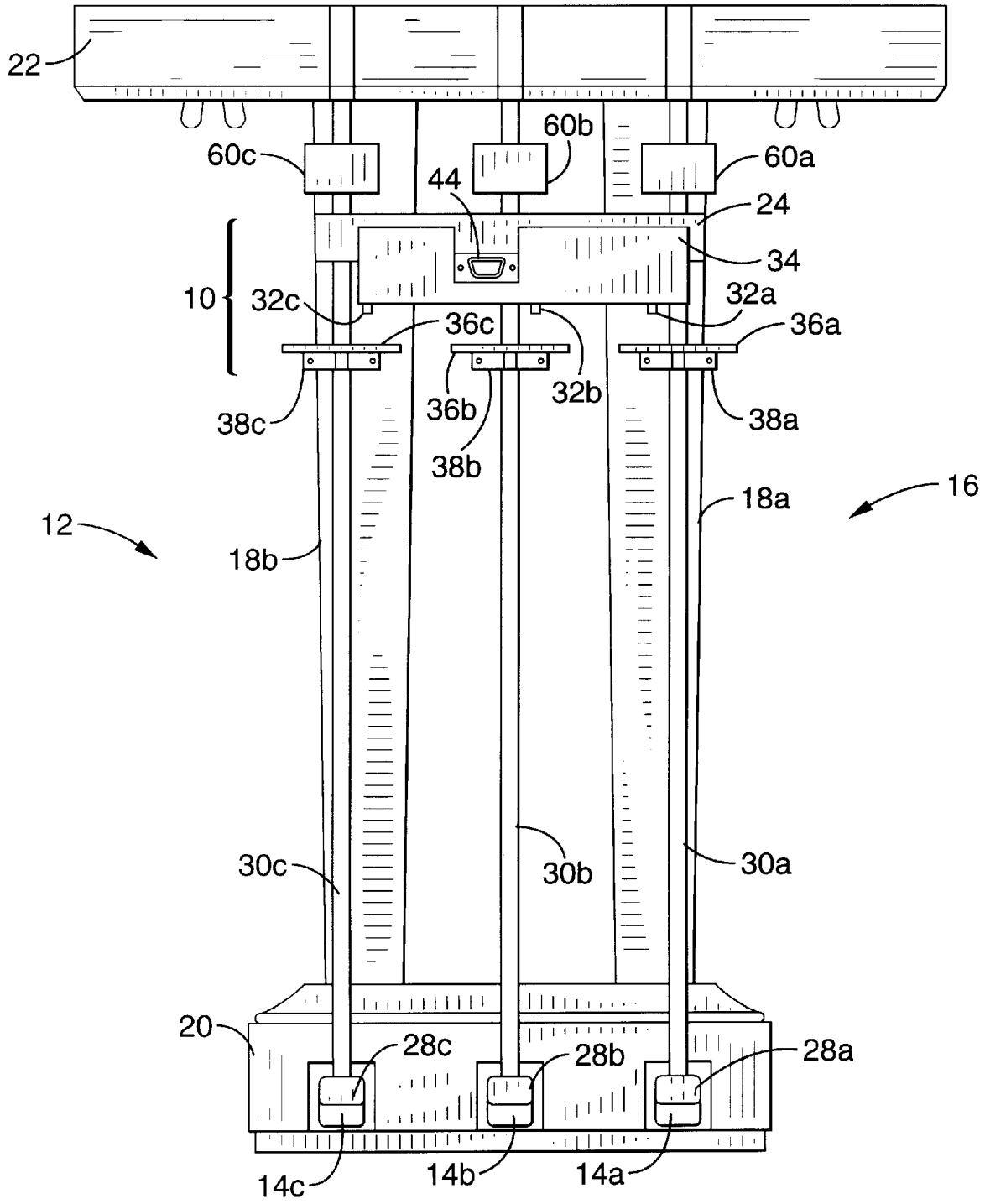
FIG. 1 is a rear elevation view of a piano pedal optical sensor apparatus in accordance with the present invention shown with a piano pedal assembly
Figure 2:
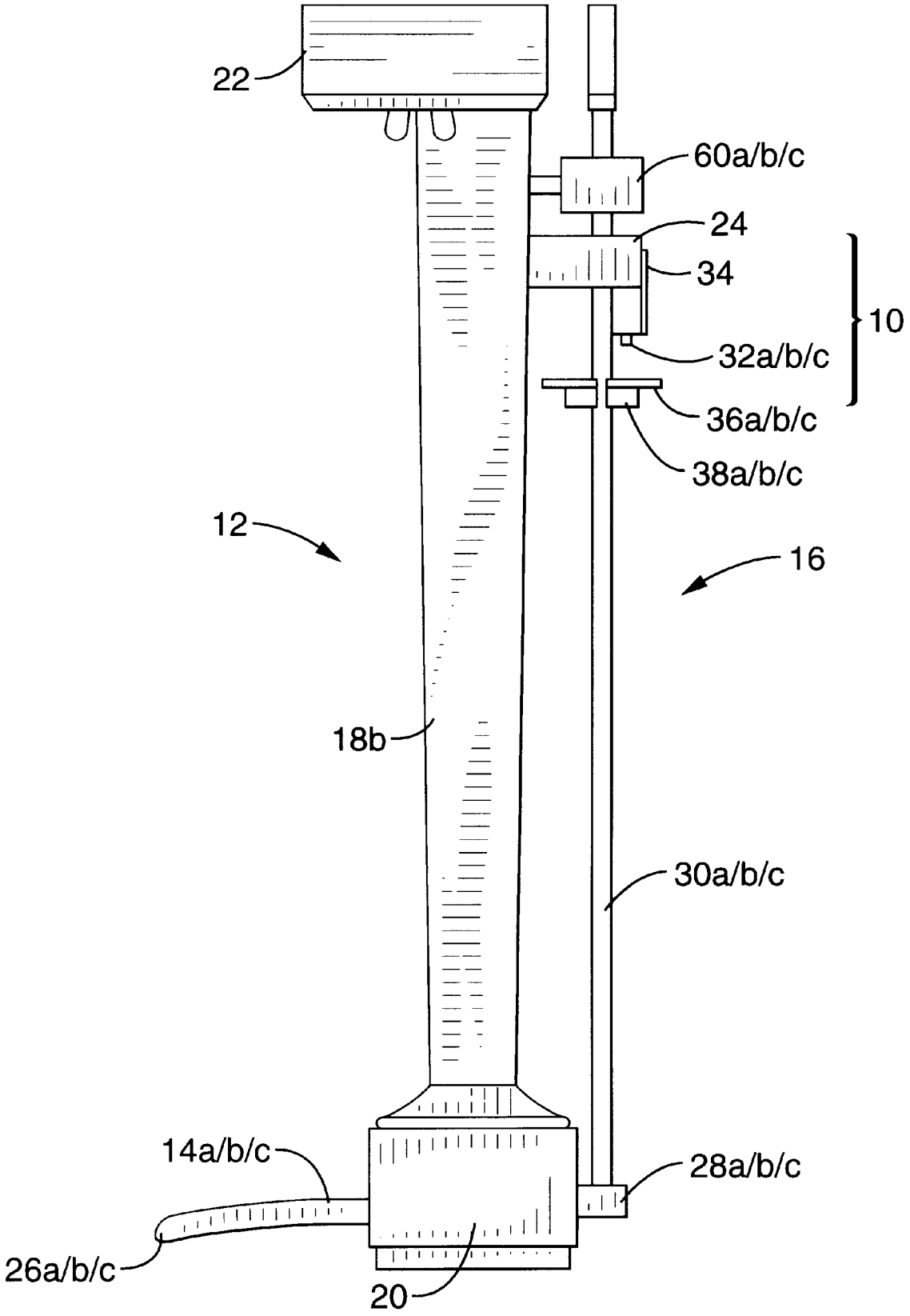
FIG. 2 is a side elevation view of the piano pedal optical sensor apparatus and pedal assembly of FIG. 1.

Referring more particularly to FIG. 3, as well as to FIG. 1 and FIG. 2, each optical emitter/sensor device 32*a*, 32*b*, 32*c* includes two basic components; a light emitting diode or LED 40*a*, 40*b*, 40*c*, and a phototransistor optical sensor 42*a*, 42*b*, 42*c*, respectively, which are preferably provided in a single package such as a Kodenshi SG 107 device. LEDs 40*a*, 40*b*, 40*c* are preferably GaAs or GaAsP type devices which emit near infrared light at a wavelength of 980 nanometers. Light 44 is emitted from LEDs 40*a*, 40*b*, 40*c*, strikes the corresponding optical reflectors 36*a*, 36*b*, 36*c*, and is reflected back and sensed or detected by the corresponding optical sensors 42*a*, 42*b*, 42*c*. Optical sensors 42*a*, 42*b*, 42*c* generally operate as valves controlling the amount of current flow between their collector and emitter terminals. LEDs 40*a*, 40*b*, 40*c* are each activated by application of a driving voltage $V_D$ to one input terminal, the other input terminal being connected to the ground through a current limiting resistor $R_L$. Optical sensors 42*a*, 42*b*, 42*c*, which are coupled to a source voltage $V_{cc}$, each turn on and produce an analog DC output voltage $V_{OUT}$. The output voltage intensity varies according to detected light, which varies with the distance separating emitter/sensors 32*a*, 32*b*, 32*c* from reflectors 36*a*, 36*b*, 36*c*, which in turn varies according to the movement of pedals 14*a*, 14*b*, 14*c*. During a piano performance in which a pianist actuates pedals 14*a*, 14*b*, 14*c* (and thus causes reflectors 36*a*, 36*b*, 36*c* to move accordingly), the output voltage signals from optical sensors 42*a*, 42*b*, 42*c* thus provide accurate pedal expression information from the piano performance which is used to determine and record pedal position or expression values as described below.

The output voltage signals provided by optical sensors 42*a*, 42*b*, 42*c* are proportional to the amount or intensity of reflected light from optical reflectors 36*a*, 36*b*, 36*c* which is sensed or detected by optical sensors 42*a*, 42*b*, 42*c*. The intensity of light from LEDs 40*a*, 40*b*, 40*c* reflected by optical reflectors 36*a*, 36*b*, 36*c* and detected by optical sensors 42*a*, 42*b*, 42*c* varies generally with the position of optical reflectors 36*a*, 36*b*, 36*c*, the attached connecting rods 30*a*, 30*b*, 30*c*, and the foot pedals interfaced therewith. Preferably, optical emitters/sensors 32*a*, 32*b*, 32*c* and corresponding optical reflectors 36*a*, 36*b*, 36*c* are separated by a distance which optimizes the light detection efficiency of optical sensors 42*a*, 42*b*, 42*c* and maximizes the output voltage signals therefrom. The optimum separation distance between optical emitter/sensors 32*a*, 32*b*, 32*c* and optical reflectors 36*a*, 36*b*, 36*c* will vary with the pedal configuration and action of individual acoustic pianos. Generally, optical emitter/sensors 32*a*, 32*b*, 32*c* and optical reflectors 36*a*, 36*b*, 36*c* are separated by a distance such that they do not come into physical contact at their closest approach, with the closest approach occurring when the associated foot pedal is in its fully depressed position.

The invention includes means for generating pedal position information, data or values according to the output voltage signals from sensors 42*a*, 42*b*, 42*c* of optical emitter/sensors 32*a*, 32*b*, 32*c*. Referring more particularly to FIG. 4, as well as FIG. 1 through FIG. 3, the pedal position information generating means generally comprises a system control computer 44 or like programmed data processing means. Control computer 44 includes a central processing unit or CPU 46 which is an 8501-type microcontroller or the like. CPU 46 is interfaced with or operatively coupled to a multiplexing analog to digital (A/D) converter 48 such as a MAX155 or the like. A/D converter 48 is interfaced with or operatively coupled to optical sensors 42*a*, 42*b*, 42*c*. The voltage outputs of sensors 42*a*, 42*b*, 42*c* of optical emitter/sensors 32*a*, 32*b*, 32*c* are simultaneously read and digitized by A/D converter 48. Random access memory (RAM) 50 is included with control computer 44, and digitized voltage outputs from optical sensors 42*a*, 42*b*, 42*c* are periodically sampled by CPU 46, preferably at intervals of one millisecond, and stored in RAM 50 and processed by CPU 46.

Control computer 44 also includes data storage means in the form of read only memory (ROM ) 52 that contains working variables and control programs that are used to convert the voltage outputs from the optical sensors to are converted to Musical Instrument Digital Interface (MIDI) values or the like. ROM 52 may alternatively comprise a conventional PROM, EPROM, or EEPROM, and may be internal or external to control computer 44. ROM 52 is preferably of a flash-type so that its contents can be updated or modified as desired. For conversion to MIDI format values, the total pedal distance traveled is equally divided into 127 discrete steps of progressive actuation, with the conversion relationship between voltage and distance being determined by empirical data. The pedal position would be stored as MIDI+127 since the pedal expression table begins at MIDI velocity 128.

Means for recording the pedal position values determined by CPU 48 are included with the invention and preferably comprise a disk drive data recorder 54 which stores information on magnetic or optical disks 56 (as well as reads information from disks 56). A uniform asynchronous receiver transmitter or UART 58 provided to serve as a communication interface between control computer 44 and data recorder 54. Data recorder 54 may alternatively comprise a magnetic tape drive or other standard recording means. The MIDI pedal position values determined by CPU 48 from the look-up tables are transferred to and stored on disks 56 by data recorder 54.

The invention preferably includes means for reproducing or recreating pedal expression according to the recorded MIDI pedal position values determined by CPU 48 from the output voltage signals of optical sensors 42*a*, 42*b*, 42*c*. The pedal expression reproduction means preferably comprises a plurality of solenoids 60*a*, 60*b*, 60*c* which are positioned to move or drive pedals 14*a*, 14*b*, 14*c* and/or corresponding connecting rods 30*a*, 30*b*, 30*c* in response to recorded MIDI pedal expression values. Solenoids 60*a*, 60*b*, 60*c* are operatively coupled to a solenoid driver 62, and solenoid driver 62 is interfaced with control computer 44 and CPU 48. Recorded MIDI pedal position values are read from disks 56 by disk drive 54 and provided to CPU 48. RAM 50 includes programming for correlating the recorded MDI values with the pedal position data within one or more look-up tables stored in ROM 52. These look-up tables contain data or values for driving the solenoids that are representative of piano pedal positions and are typically developed from empirical data obtained by playing the piano.

The pedal position data thus correlated by CPU 48 is then directed to solenoid driver 62, preferably using pulse width modulation. An exemplary pulse width modulation scheme is described in copending application Ser. No. 08/770,069, which is incorporated herein by reference. Instructions from controlling programs in RAM 50 are routed to solenoid driver 62 by CPU 48, and solenoid driver 62 drives or actuates solenoids 60*a*, 60*b*, 60*c* according to the analog signals. The solenoids 60*a*, 60*b*, 60*b* move pedals 14, 14*b*, 14*c* and corresponding connecting rods 30*a*, 30*b*, 30*c* to activate the key damping and shifting mechanisms internal to the piano to reproduce the pedal expression of the original piano performance. Solenoids 60*a*, 60*b*, 60*c* are shown as positioned adjacent pedal heels 28*a*, 28*b*, 28*c* and connecting rods 30*a*, 30*b*, 30*c* to move or drive pedal heels 28*a*, 28*b*, 28*c* and connecting rods 30*a*, 30*b*, 30*c* upward. Solenoids 60*a*, 60*b*, 60*c*, however, may alternatively be located elsewhere on pedal assembly 12 and suitably positioned to actuate the key damping and shifting mechanisms associated with pedals 14*a*, 14*b*, 14*c*.

The means for reproducing pedal expression from recorded pedal position values may be included on a separate or second piano, wherein the recorded MIDI values are read from a disk drive and processed by a computer which are separate from the disk drive 54 and computer 44 used on the first piano for generating and recording the pedal position values from the output voltage signals. The first piano would include optical emitters/sensors 32*a*, 32*b*, 32*c*, while the second piano includes solenoids 60*a*, 60*b*, 60*c*. Such an arrangement of the invention would otherwise operate in the same manner as described above.

The retrofitting or modification of any acoustic piano or like keyboard instrument to use the present invention is relatively simple since the optical emitter/sensors 32*a*, 32*b*, 32*c*, optical reflectors 36*a*, 36*b*, 36*c* and solenoids 60*a*, 60*b*, 60*c* are all mounted on external portions of pedal assembly 12, and thus extensive modification of the instrument is not required in order to use the invention. As related above, the location of optical emitter/sensors 32*a*, 32*b*, 32*c*, optical reflectors 36*a*, 36*b*, 36*c* and solenoids 60*a*, 60*b*, 60*c* may be varied to accommodate pedal assemblies of different structure and configuration.

The method of using the piano optical sensor apparatus 10 of the invention will be more fully understood by reference to FIG. 5, wherein individual steps of the method are outlined, as well as to FIG. 1 through FIG. 4.

At step 100, an acoustic piano is provided or retrofitted with a plurality of optical emitters/sensors 32*a*, 32*b*, 32*c* and a plurality of corresponding optical reflectors 36*a*, 36*b*, 36*c* which are arranged such that the distance separating each optical emitter/sensor 32*a*, 32*b*, 32*c* and corresponding optical reflector 36*a*, 36*b*, 36*c* will vary according to the motion or position of a corresponding pedal 14*a*, 14*b*, 14*c*. Preferably, the optical reflectors 36*a*, 36*b*, 36*c* are mounted on connecting rods 30*a*, 30*b*, 30*c* which move in accordance with pedals 14*a*, 14*b*, 14*c* respectively. Optical emitter/sensor devices 32*a*, 32*b*, 32*c* are preferably fixedly mounted in a downward facing orientation, and optical reflectors 36*a*, 26*b*, 26*c* are positioned to reflect upward, with optical emitter/sensor devices 32*a*, 32*b*, 32*c* positioned over optical reflectors 36*a*, 36*b*, 36*c*. As described above, each optical emitter/sensor device 32*a*, 32*b*, 32*c* includes an LED 40*a*, 40*b*, 40*c*, and a phototransistor optical sensor 42*a*, 42*b*, 42*c*, respectively.

At stem 110, light is sensed by optical sensors 42*a*, 42*b*, 42*c*. As described above, light 44 emitted from LEDs 40*a*, 40*b*, 40*c* strikes the corresponding optical reflectors 36*a*, 36*b*, 36*c*, and is reflected back and sensed or detected by the corresponding optical sensors 42*a*, 42*b*, 42*c*. The intensity of light sensed by optical sensors 42*a*, 42*b*, 42*c* varies generally with the distance between optical reflectors 36*a*, 36*b*, 36*c* and optical sensors 42*a*, 42*b*, 42*c*, which in turn varies according to the movement and position of pedals 14*a*, 14*b*, 14*c*.

At step 120, output voltage signals in analog format are generated by optical sensors 42*a*, 42*b*, 42*c* according to light 44 emitted from LEDs 40*a*, 40*b*, 40*c* which strikes the corresponding optical reflectors 36*a*, 36*b*, 36*c*, and is reflected back and sensed or detected by the corresponding optical sensors 42*a*, 42*b*, 42*c*. The intensity of light detected by optical sensors 42*a*, 42*b*, 42*c*, and thus the output voltage signals generated by optical sensors 42*a*, 42*b*, 42*c*, varies according to the position and movement of pedals 14*a*, 14*b*, 14*c* and provides pedal expression information.

At step 130, the analog output voltage signals from optical sensors 42*a*, 42*b*, 42*c* are converted to digital format. This step is generally carried out by a conventional analog to digital converter 48 which is interfaced with optical sensors 42*a*, 42*b*, 42*c*.

At step 140, the output voltage signals from sensors 42*a*, 42*b*, 42*c* are monitored. Monitoring step 140 is preferably carried out control computer 44, by periodically sampling, at intervals of one millisecond, the digitized output of each optical sensor 42*a*, 42*b*, 42*c*.

At step 150, pedal position values are generated or determined from the output voltage signals from optical sensors 42*a*, 42*b*, 42*c*. As described above, control computer 44 includes a ROM 52 containing "look-up" tables of MIDI pedal position data which are representative of piano pedal positions. CPU 48 examines the look-up tables in ROM 52 according to programming stored in RAM 50 and compares the sampled, digitized output of sensors 42*a*, 42*b*, 42*c* to pedal position values in the look-up tables to determine or generate a MIDI pedal position value for each sampled sensor output signal.

At step 160, the pedal position values determined in step 150 are recorded, preferably onto a conventional magnetic floppy disk 56 by a disk drive data recorder 54.

At step 170, piano pedal expression is reproduced or recreated according to the recorded pedal position values. As related above, the invention includes solenoids 60*a*, 60*b*, 60*c* positioned to drive pedals 14*a*, 14*b*, 14*c* and connecting rods 30*a*, 30*b*, 30*c* respectively according to the recorded MIDI pedal expression values. Solenoids 60*a*, 60*b*, 60*c* are interfaced with solenoid driver 62, which in turn is interfaced with control computer 44 and CPU 48. Recorded MIDI pedal position values are read from disks 56 by data recorder 54 and provided to CPU 48, which correlates the recorded values with the pedal position data in the stored look-up tables. The pedal position data thus obtained is directed to solenoid driver 62. Solenoid driver 62 drives solenoids 60*a*, 60*b*, 60*c* according to the analog signals and control programming from RAM 50. The solenoids 60*a*, 60*b*, 60*b* move pedals 14, 14*b*, 14*c* and connecting rods 30*a*, 30*b*, 30*c* respectively to activate the key damping and shifting mechanisms internal to the piano to reproduce the pedal expression of the original piano performance. The reproduction step 170 may be carried out on the same apparatus and/or piano as used in steps 10 through 160, or may be carried out on a separate, suitably equipped keyboard instrument.

Note that, while the invention is disclosed in terms of use with a piano having three pedals, it is contemplated that the apparatus 10 may be used with acoustic pianos or other keyboard instruments having a larger or smaller number of pedals. For example, many acoustic pianos, particularly of earlier design, do not include the una corda pedal. Similarly, modern electronic keyboard instruments may include numerous foot pedals to achieve various musical effects. The present invention may be used with these instruments by suitably retrofitting the instruments with the appropriate number of optical emitter/sensors 32, and optical reflectors 36 in the manner described above.

Accordingly, it will be seen that this invention provides a piano pedal optical sensor apparatus and method which accurately records and reproduces the pedal expression generated during piano performances, and which can be easily retrofitted onto existing acoustic pianos or like keyboard instruments. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A piano pedal sensor apparatus, comprising:

(a) at least one optical reflector, said optical reflector mounted on a piano pedal assembly;

(b) at least one optical emitter and corresponding optical sensor, said optical emitter and optical sensor mounted on a piano pedal assembly, said optical emitter positioned to emit light towards said optical reflector, said optical sensor positioned to sense light reflected by said optical reflector, said optical sensor producing an output voltage signal responsive to intensity of said sensed light;

(c) said optical reflector separated from said optical emitter and said optical sensor by a distance which varies in response to movement of a piano pedal; and (c) means for generating pedal position values responsive to said output voltage of said optical sensor.

2. An apparatus as recited in claim 1, further comprising means for recording said pedal position values.

3. An apparatus as recited in claim 1, wherein said pedal position value generating means comprises a control computer, said control computer operatively coupled to said optical sensor, said control computer including a stored look-up table of pedal position data, said control computer including program means for determining said pedal position values from said stored look-up table which corresponds to said output voltage from said optical sensor.

4. An apparatus as recited in claim 3, wherein said pedal position value generating means further comprises an analog to digital converter, said analog to digital converter operatively coupled to said optical sensor and said control computer.

5. An apparatus as recited in claim 2, further comprising means for reproducing pedal expression from said recorded pedal position values.

6. A piano pedal sensor apparatus, comprising:

(a) a plurality of optical reflectors, each said reflector mounted on a moving portion of a piano pedal assembly;

(b) a plurality of optical emitters and corresponding optical sensors, said optical emitters and optical sensors mounted on a stationary portion of said piano pedal assembly, each said optical emitter positioned to emit light towards a corresponding said optical reflector, each said optical sensor positioned to sense light reflected by said corresponding said optical reflector, each said optical sensor producing an output voltage responsive to intensity of said sensed light;

(c) an analog to digital converter, said analog to digital converter operatively coupled to each said optical sensor; and (d) a control computer, said control computer operatively coupled to said analog to digital converter, said control computer including a stored look-up table of pedal position data, said control computer including program means for periodically sampling digitized optical sensor output from said analog to digital converter and for determining pedal position values from said pedal position data in said stored look-up table which correspond to said sampled digitized optical sensor output.

7. An apparatus as recited in claim 6, further comprising means for recording said pedal position values, said recording means operatively coupled to said control computer.

8. An apparatus as recited in claim 7, firther comprising means for reproducing pedal expression from said recorded pedal position values.

9. An apparatus as recited in claim 8, wherein said piano pedal expression reproducing means comprises:

(a) a digital to analog converter, said digital to analog converter operatively coupled to said control computer;

(b) a solenoid driver, said solenoid driver operatively coupled to said digital to analog converter; and (c) a plurality of solenoids, said solenoids operatively coupled to said solenoid driver, each said solenoid mechanically interfaced with a piano pedal.

10. An apparatus as recited in claim 9, wherein said control computer includes program means for correlating said recorded pedal position values with said pedal position data in said stored look-up table and directing said correlated pedal position data to said digital to analog converter.

11. A method for detecting pedal expression in an acoustic piano performance, comprising the steps of:

(a) providing a plurality of optical reflectors, each said reflector mounted on a piano pedal assembly;

(b) providing a plurality of optical emitters and corresponding optical sensors, said optical emitters and optical sensors mounted on said piano pedal assembly, each said optical emitter positioned to emit light towards a corresponding said optical reflector, each said optical sensor positioned to sense light reflected by said corresponding said optical reflector, said optical reflectors separated from said corresponding said optical emitters and said optical sensors by a distance which varies in response to movement of piano pedals;

(c) sensing, by said optical sensors, light from said optical emitters which is reflected by said optical reflectors; and (d) determining pedal position values according to said light sensed by said optical sensors.

12. A method as recited in claim 11, further comprising the step of generating output voltage signals by said optical sensors, said output voltage responsive to said light sensed by said optical sensors.

13. A method as recited in claim 12, further comprising the step of digitizing said output voltage signals from said optical sensors.

14. A method as recited in claim 13, wherein said determining step further comprises the step of monitoring said digitized output voltage signals from said optical sensors.

15. A method as recited in claim 14, wherein said determining step further comprising the step of comparing said digitized output voltage signals to stored pedal position data and selecting therefrom a corresponding pedal position value for each said digitized output voltage signal.

16. A method as recited in claim 11, further comprising the step of recording said pedal position values.

17. A method as recited in claim 16, further comprising the step of reproducing pedal expression from said recorded pedal position values.

18. A method as recited in claim 17, wherein said pedal expression reproducing step firther comprises the step of generating pulse width modulation signals according to said recorded pedal position values.

19. A method as recited in claim 18, wherein said pedal expression reproducing step further comprises the step of actuating a plurality of solenoids in response to said pulse width modulation signals, each said solenoid mechanically interfaced with a piano pedal.

* * * * *